US010648665B2

(12) United States Patent
Harel

(10) Patent No.: US 10,648,665 B2
(45) Date of Patent: May 12, 2020

(54) POCKET LIGHTER WITH A SNAP-IN BURNER ASSEMBLY

(71) Applicant: Yigal Cohen Harel, Ratingen (DE)

(72) Inventor: Yigal Cohen Harel, Ratingen (DE)

( * ) Notice: Subject to any disclaimer, the term of this patent is extended or adjusted under 35 U.S.C. 154(b) by 0 days.

(21) Appl. No.: 15/978,378

(22) Filed: May 14, 2018

(65) Prior Publication Data

US 2019/0346137 A1 Nov. 14, 2019

(51) Int. Cl.
*F23Q 2/167* (2006.01)
*F23Q 3/01* (2006.01)
*F23Q 2/28* (2006.01)

(52) U.S. Cl.
CPC ..... *F23Q 2/167* (2013.01); *F23Q 2/287* (2013.01); *F23Q 3/01* (2013.01)

(58) Field of Classification Search
CPC ..... F23Q 2/167; F23Q 2/287; F23Q 3/01
See application file for complete search history.

(56) References Cited

U.S. PATENT DOCUMENTS 5,082,440 A * 1/1992 Yamamoto ..... F23D 14/28 431/143
5,531,592 A * 7/1996 Tasi ..... F23D 14/28 431/255
2004/0224272 A1* 11/2004 Rakowski ..... F23Q 2/52 431/344
2018/0320896 A1* 11/2018 VanCleave, III ..... F23D 14/465

* cited by examiner

*Primary Examiner* — Grant Moubry
*Assistant Examiner* — Aaron H Heyamoto
(74) *Attorney, Agent, or Firm* — Malone IP Law; Steven J. Malone

(57) ABSTRACT

A pocket lighter with a snap-in burner assembly unit has been developed. The pocket lighter includes a snap-in burner assembly unit comprising: a fuel input port, a fuel regulator, a jet nozzle, and a burner cylinder. The pocket lighter additionally includes a lighter base comprising: a fuel tank, a fuel output port, a fuel ignition source, a fuel lever, and a push button mechanism for actuating the fuel lever and creating a spark; and wherein the fuel input port and the fuel output port mate together forming an airtight seal when the snap-in burner is installed within the lighter base.

18 Claims, 11 Drawing Sheets

ORIGIN

15° ROTATION

30° ROTATION

POCKET LIGHTER WITH A SNAP-IN BURNER ASSEMBLY

FIELD OF THE INVENTION

The present invention is related to pocket lighters with replaceable components.

SUMMARY

A pocket lighter with a snap-in burner assembly unit has been developed. The pocket lighter includes a snap-in burner assembly unit comprising: a fuel input port, a fuel regulator, a jet nozzle, and a burner cylinder. The pocket lighter additionally includes a lighter base comprising: a fuel tank, a fuel output port, a fuel ignition source, a fuel lever, and a push button mechanism for actuating the fuel lever and creating a spark; and wherein the fuel input port and the fuel output port mate together forming an airtight seal when the snap-in burner is installed within the lighter base.

The lighter base may further comprise an insulator which receives a conductive portion of a high voltage spark ignitor as the snap-in burner is installed within the lighter base. The insulator may have a tapered opening where the conductive portion of the high voltage spark ignitor is received. The conductive portion of the high voltage spark ignitor and the high voltage conductor may be electrically connected by direct contact, by a defined distance, by a gap, or by a conductive paste. The burner unit may produce a soft flame, torch flame, twin flame, circular flame, or a combination thereof. The lighter base may further comprise a burner assembly release/lock lever. The fuel outlet port may further comprise one or more O-ring seals. The release/locklever may be spring loaded. The release/locklever may be spring loaded in a normally locked position. The release/locklever may be actuated to release the snap-in burner assembly by pushing a pushpin actuator attached to the snap-in burner assembly. The snap-in burner assembly may be locked in place by rotating a locking nut. The lighter base output port may be a pivoting output port. The lighter base may further comprise a flexible gas tube that connects lighter fuel of the pocket lighter to the pivoting output port. The snap-in burner assembly may snap into the pivoting output port. The snap-in burner assembly may rotationally pivot away from the push button mechanism between 0 and 30 degrees. The snap-in burner assembly may be a user replaceable accessory of the pocket lighter. The pivoting output port may comprise one or more notches for positionally fixing an angle of rotation of the snap-in burner assembly. The flexible gas tube may connect to a 90-degree fitting of the pivoting output port. The 90-degree fitting may further comprise one or more O-ring seals. The one or more O-rings seals may create an airtight seal with the input port of the snap-in burner assembly.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presentl y contemplated embodiments in accordance with the invention. The presently described embodiments will be best understood by reference to the drawings.

Figure 1A:
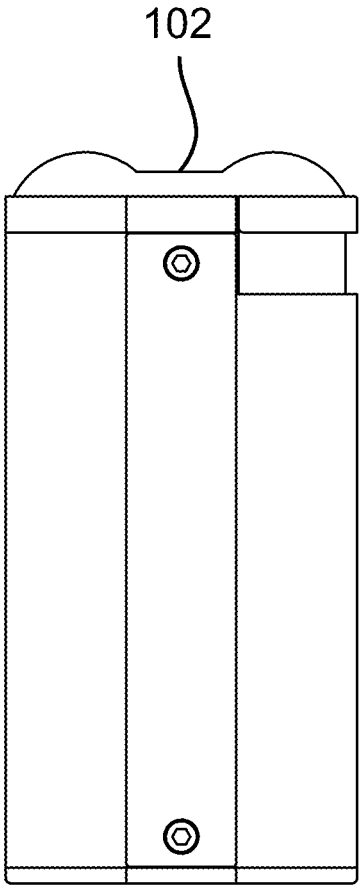
FIGS. 1A and 1B are side views of a pocket lighter with a snap-in burner assembly installed and uninstalled in accordance with an embodiment of the invention.
Figure 1B:
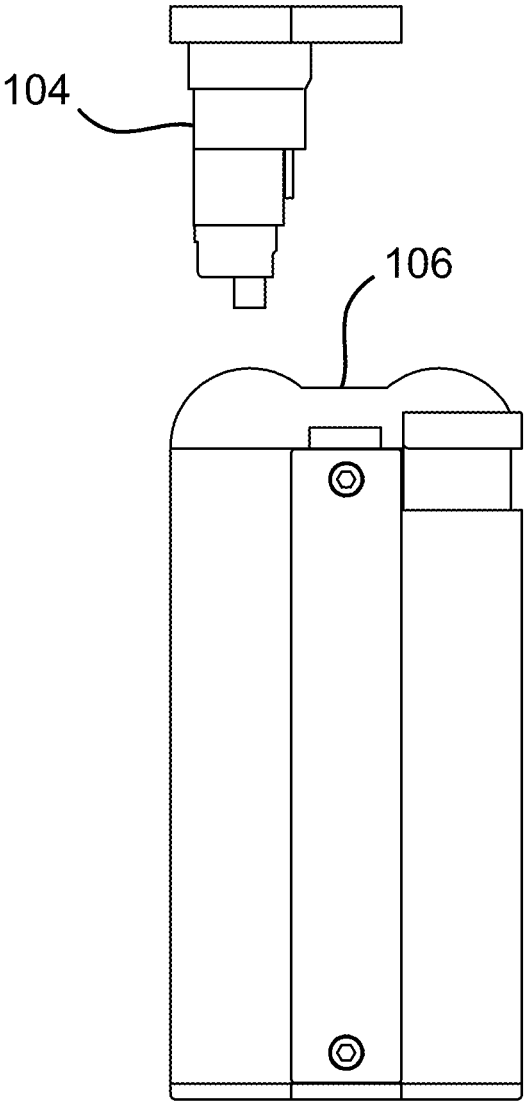

FIGS. 1A and 1B are side views of a pocket lighter with a snap-in burner assembly 104 installed 102 and uninstalled 106 in accordance with an embodiment of the invention.

Figure 2:
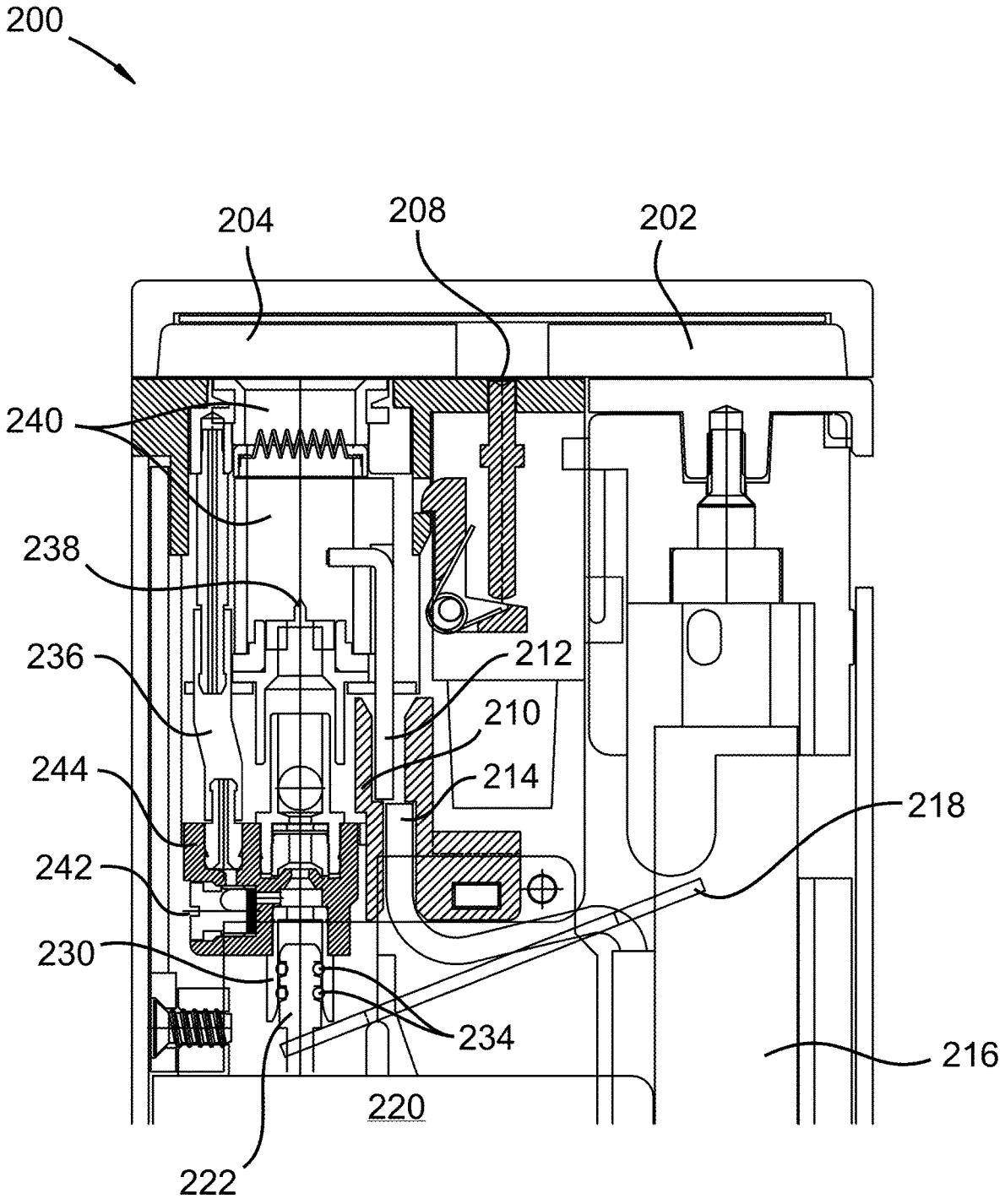
FIG. 2 is a cross-sectional side view of a pocket lighter with a snap-in burner assembly in accordance with an embodiment of the invention.

FIG. 2 shows a sideview 200 of a pocket lighter with a snap-in burner assembly in accordance with an embodiment of the invention. Piezo-electric spark generator 216 generates a high voltage electric spark when depressed. The high voltage spark travels through high voltage conductor 214 into insulator 210. Insulator 210 electrically joins high voltage conductor 214 and high voltage spark ignitor 212 allowing for easy removal and installation of the snap-in burner assembly. Insulator 210 is designed to bring high voltage conductor 214 and high voltage spark ignitor 212 into an acceptable proximity to each other allowing a high voltage spark to be transmitted into burner chamber 240. In one embodiment, a small gap or small misalignment is designed for between high voltage conductor 214 and high voltage spark ignitor 212 as shown in FIG. 2. Because of the nature of the high voltage generated by piezo-electric unit 216, high voltage conductor 214 and high voltage spark ignitor 212 do not need to directly touch each other to conduct a high voltage spark. Perfect alignment is not necessary and may cause mechanical difficulties snapping in and taking out the burner assembly. In another embodiment, high voltage conductor 214 and high voltage spark ignitor 212 share a side-by-side path extending in partially overlapping space. In another embodiment, high voltage conductor 214 and high voltage spark ignitor 212 are end connected by touching end-to-end. In another embodiment, insulator 210 is lined with an inner conductive surface or has a conductive paste applied to an inner surface which is shared between high voltage conductor 214 and high voltage spark ignitor 212 and serves to increase electrical conductivity between high voltage conductor 214 and high voltage spark ignitor 212. Fuel lever 218 is simultaneously depressed as piezo-electric generator 216 is depressed by a push button of the lighter. When depressed, fuel lever 218 lifts and opens fuel outlet valve 222 releasing pressurized fuel from fuel tank 220. O-rings 234 form an airtight seal between the snap-in burner assembly and outlet valve 222 for safe delivery of fuel to the burner area 240. The pressurized fuel travel into fuel regulator device 242. Fuel regulator device 242 serves to control pressure and/or volume of fuel supplied to burner area 240. Fuel regulator device 242 may be factory adjustable or may be user adjustable to achieve an optimal or desired fuel burn within burner area 240. A fuel regulator 242 and fuel distribution system is housed by cross-hatched structure 244. A fuel distribution tube 236 is used to provide fuel into burner area 240. Burner area 240 is shown as a circular burner unit with spark ignitor 212 providing a high voltage spark against ground point 238 to ignite fuel within burner area 240. Burner area 240 also includes one or more jet nozzles for delivering fuel to the circular burner unit 240. In other embodiments, a traditional friction spark ignition system may be used instead of the pi ezo-el ectri c spark generator.

Figure 3:
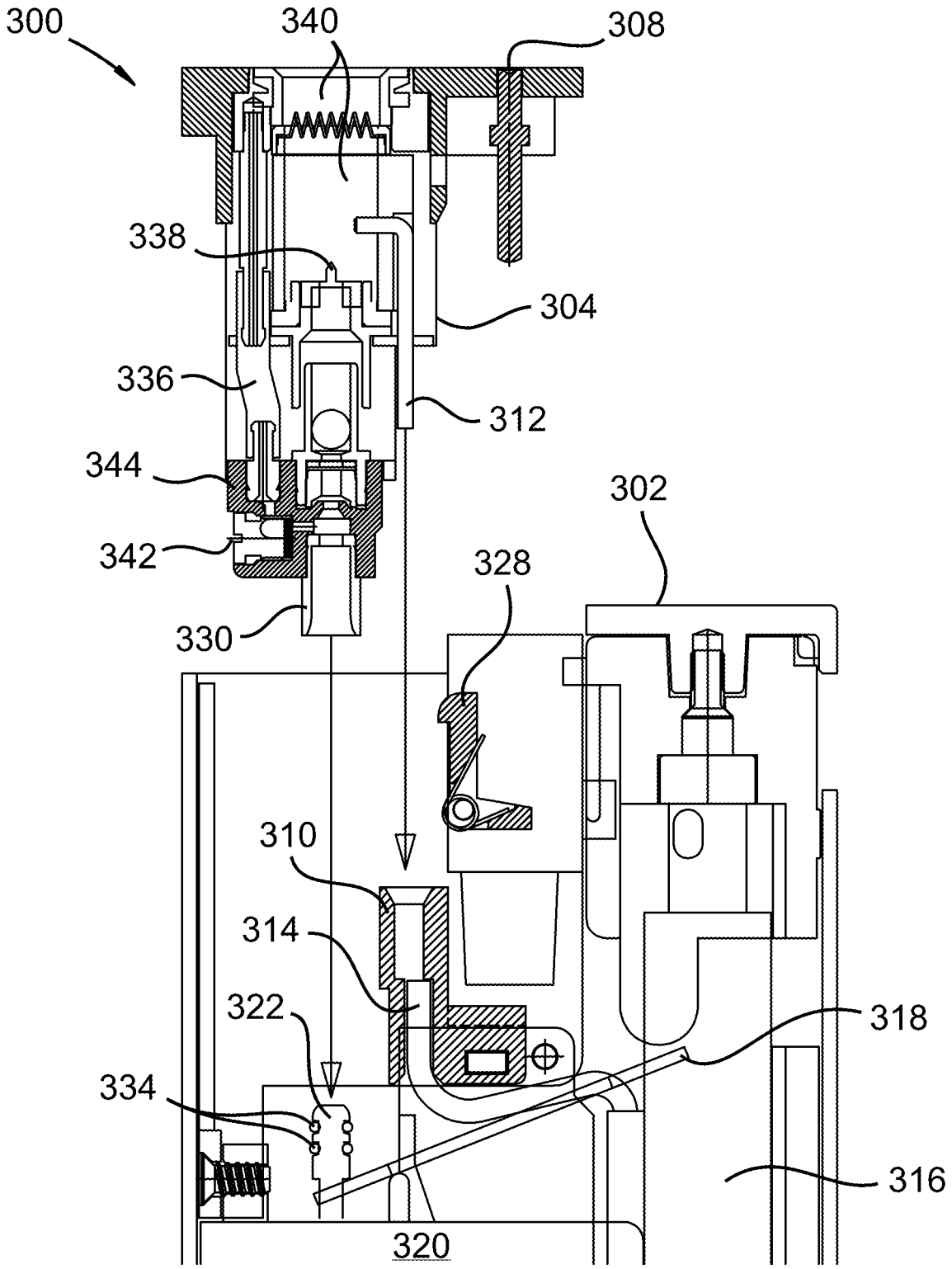
FIG. 3 a cross-sectional side view of a pocket lighter with a snap-in burner assembly in accordance with an embodiment of the invention.

FIG. 3 is a sideview 300 of a pocket lighter with a snap-in burner assembly in accordance with an embodiment of the invention. Pushpin actuator 308 is releases the snap-in burner assembly by depressing the release/lock lever 328. Release/lock lever 328 may be spring loaded in a normally locked position allowing the snap-in burner assembly to snap in when pressed into the lighter base. Piezo-electric spark generator 316 generates a high voltage electric spark when depressed. The high voltage spark travels through high voltage conductor 314 into insulator 310. Insulator 310 electrically joins high voltage conductor 314 and high voltage spark ignitor 312 allowing for easy removal and installation of the snap-in burner assembly. Insulator 310 is designed to bring high voltage conductor 314 and high voltage spark ignitor 312 into an acceptable proximity to each other allowing a high voltage spark to be transmitted into burner chamber 340. In one embodiment, a small gap or small misalignment is designed for between high voltage conductor 314 and high voltage spark ignitor 312 as shown in FIG. 3. Because of the nature of the high voltage generated by piezo-electric unit 316, high voltage conductor 314 and high voltage spark ignitor 312 do not need to directly touch each other to conduct a high voltage spark. Perfect alignment is not necessary and may cause mechanical difficulties snapping in and taking out the burner assembly. In another embodiment, high voltage conductor 314 and high voltage spark ignitor 312 share a side-by-side path extending in partially overlapping space. In another embodiment, high voltage conductor 314 and high voltage spark ignitor 312 are end connected by touching end-to-end. In another embodiment, insulator 310 is lined with an inner conductive surface or has a conductive paste applied to an inner surface which is shared between high voltage conductor 314 and high voltage spark ignitor 312 and serves to increase electrical conductivity between high voltage conductor 314 and high voltage spark ignitor 312. Fuel lever 318 is simultaneously depressed as piezo-electric generator 316 is depressed by push button 302 of the lighter. When depressed, fuel lever 318 lifts and opens fuel outlet valve 322 releasing pressurized fuel from fuel tank 320. O-rings 334 form an airtight seal between the snap-in burner assembly and outlet valve 322 for safe delivery of fuel to the burner area 340. The pressurized fuel travel into fuel regulator device 342. Fuel regulator device 342 serves to control pressure and/or volume of fuel supplied to burner area 340. Fuel regulator device 342 may be factory adjustable or may be user adjustable to achieve an optimal or desired fuel burn within burner area 340. A fuel regulator 342 and fuel distribution system is housed by cross-hatched structure 344. A fuel distribution tube 336 is used to provide fuel into burner area 340. Burner area 340 is shown as a circular burner unit with spark ignitor 312 providing a high voltage spark against ground point 338 to ignite fuel within burner area 340.

Figure 4A:
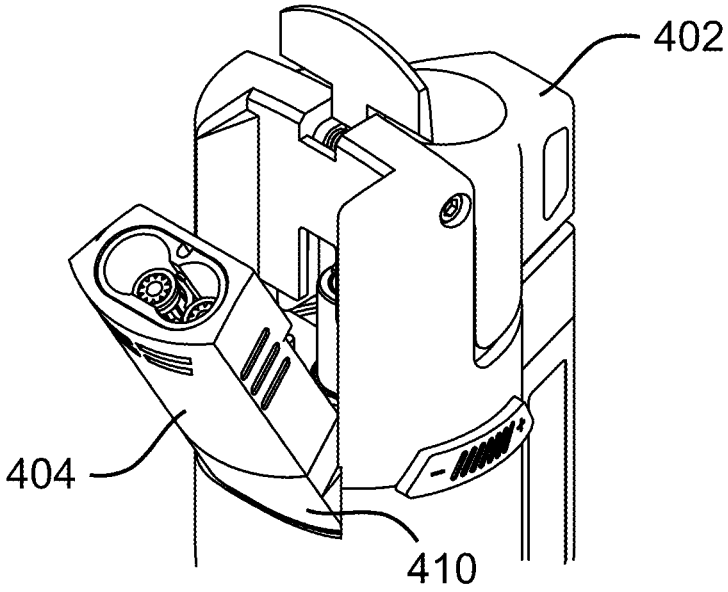
FIGS. 4A and 4B are perspective views of a pocket lighter with a snap-in burner assembly installed and uninstalled in accordance with an embodiment of the invention.

FIG. 4A shows a perspective view of a pocket lighter 402 with an installed snap-in burner unit 404 in accordance with an embodiment of the invention. Burner unit 404 may produce a soft flame, torch flame, twin flame, circular flame, or a combination thereof. Burner unit may be replaced with a desired flame type burner. For example, a user wanting to light a cigar may want a hot twin flame and install a snap-in twin flame burner. In another example, a user may want to light a cigarette and install a snap-in soft flame burner.

Figure 4B:
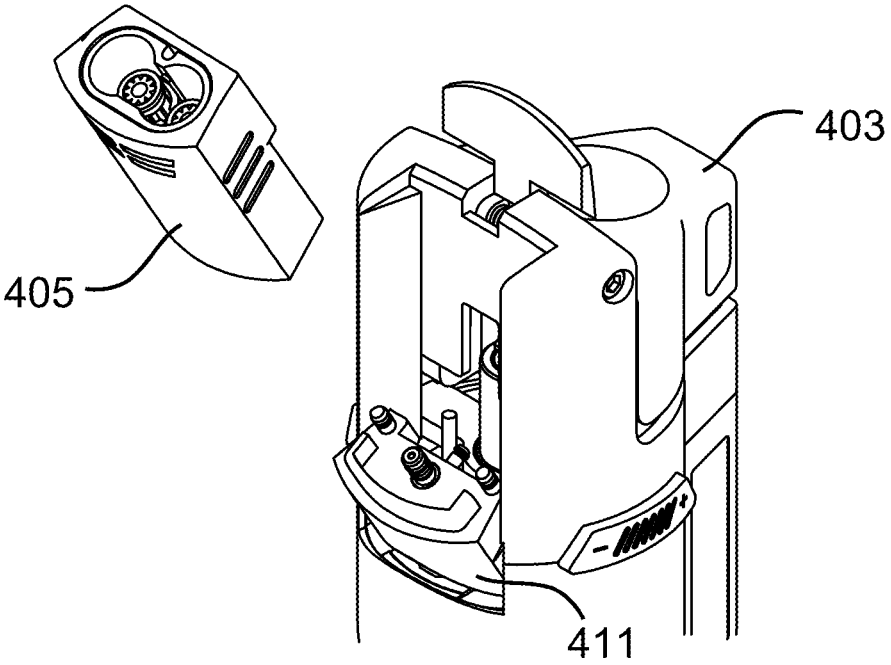

FIG. 4B shows a perspective view of a pocket lighter 403 with a removed (snapped out) burner unit 405 in accordance with an embodiment of the invention. Various types of burners and flame configurations may be used with lighters 402/403 and switch as needed for application type and user preference.

Figure 5:
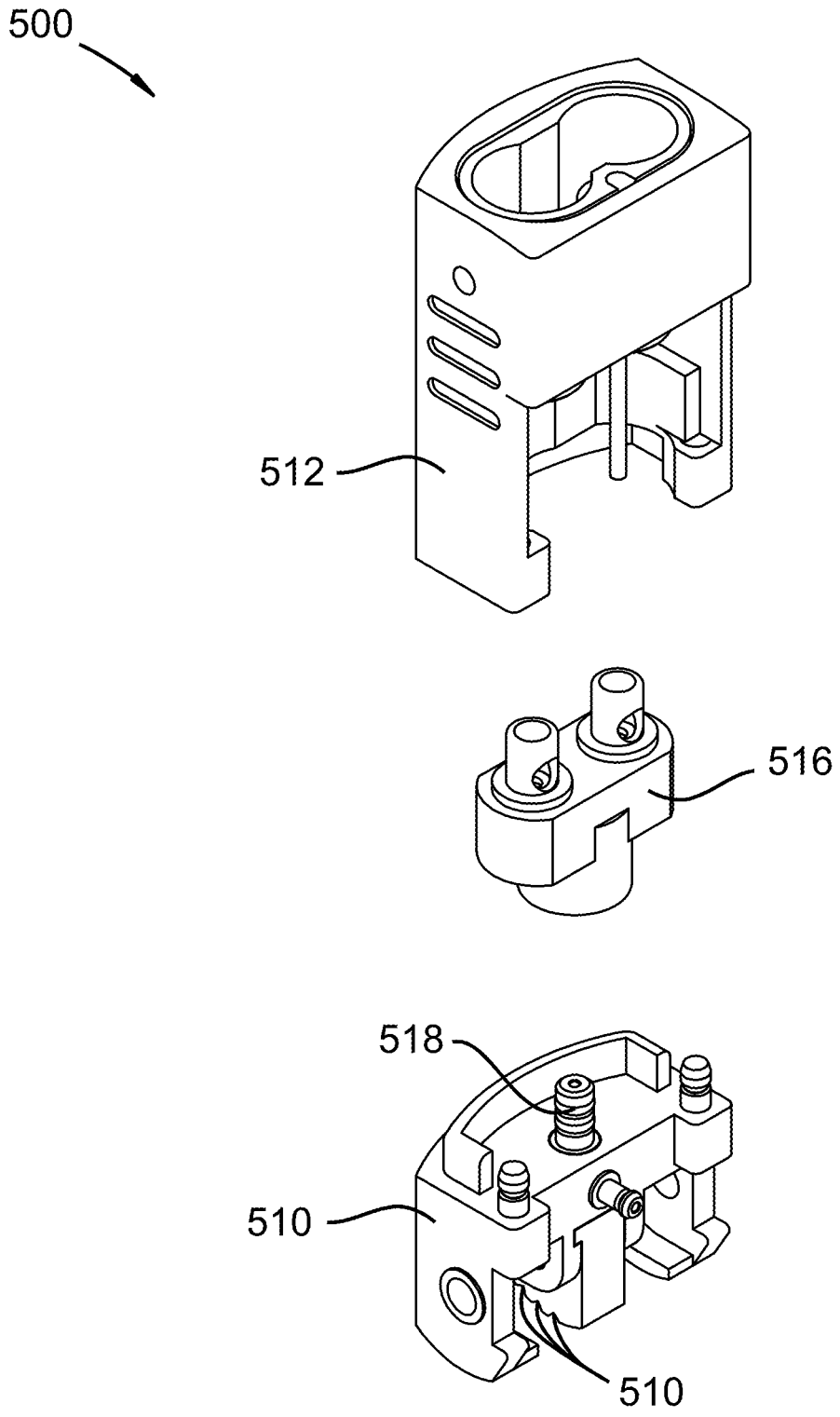
FIG. 5 is an exploded perspective view of a snap-in burner assembly in accordance with an embodiment of the invention.

FIG. 5 is an exploded perspective view of a burner unit assembly 500 in accordance with an embodiment of the invention. Burner unit assembly 500 includes a burner unit 512, an injection burner unit/jet nozzle 516, and a burner holder unit 510. Burner holder unit 510 includes one or more notches 510 for positionally fixing an angle of rotation of the burner unit assembly 500. Injection burner unit/jet nozzle 516 snaps over angle fitting 518 allowing the burner and injection burner unit to be replaced by a user without any tools.

Figure 6:
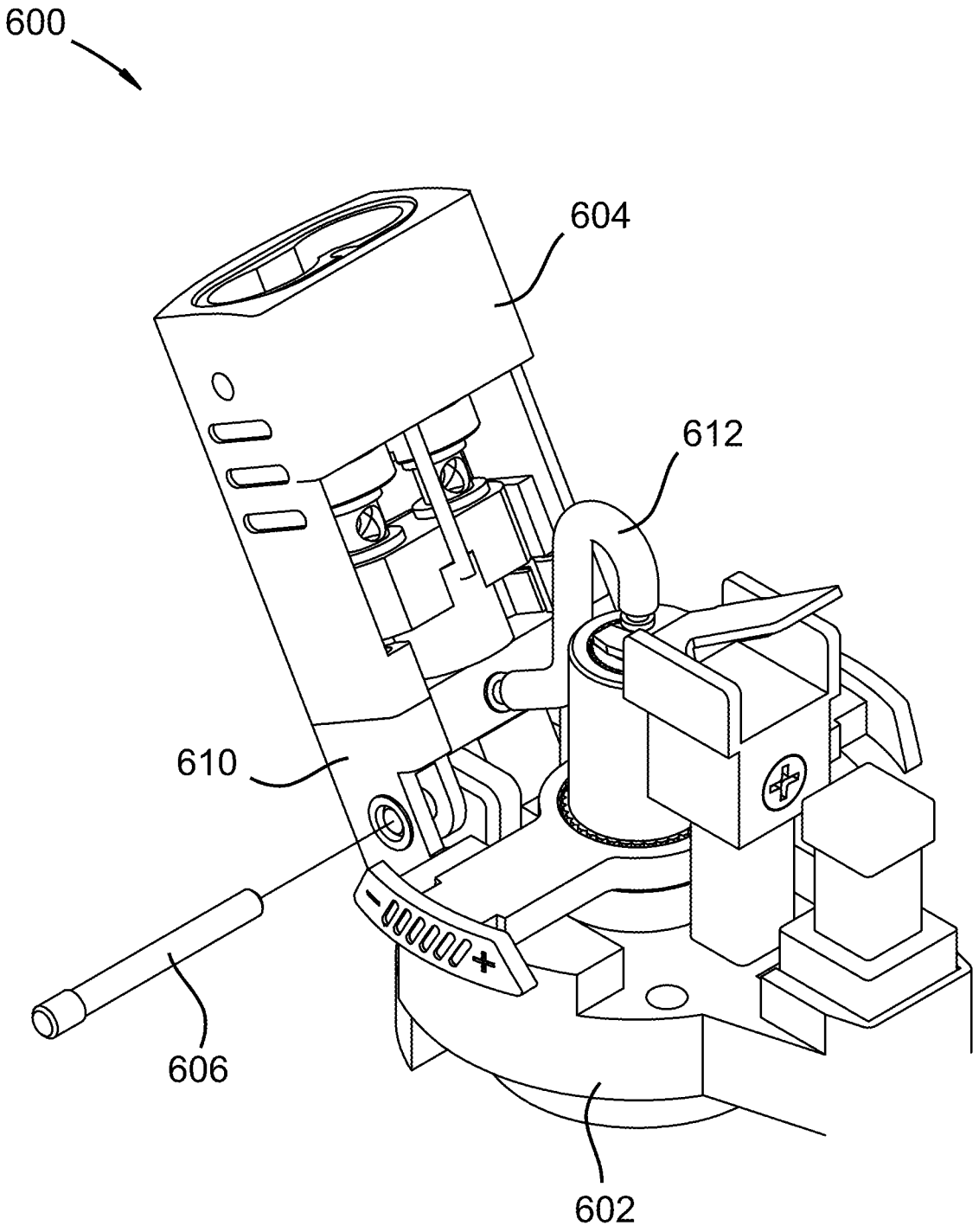
FIG. 6 shows a perspective inside view of a pocket lighter top portion with a pivoting snap-in burner assembly in accordance with an embodiment of the invention.

FIG. 6 is a perspective view of a fuel tank adaptor 600 and burner unit assembly 604/610 in accordance with an embodiment of the invention. Burner unit assembly 604/610 comprises a burner holder unit 610 and a burner unit 604. Burner holder unit 610 is connected to a main body portion 602 of fuel tank adapter 600 by a hinge pin 606 allowing rotational movement of burner assembly 604/610. Flexible gas tube 612 connects an outlet of gas outlet nozzle to an input of the burner holder unit 610. Flexible gas tube 612 allows burner holder unit 610 to rotate about an axis formed by the mounting hinge pin while still supplying fuel to the top burner unit 604.

Figure 7:
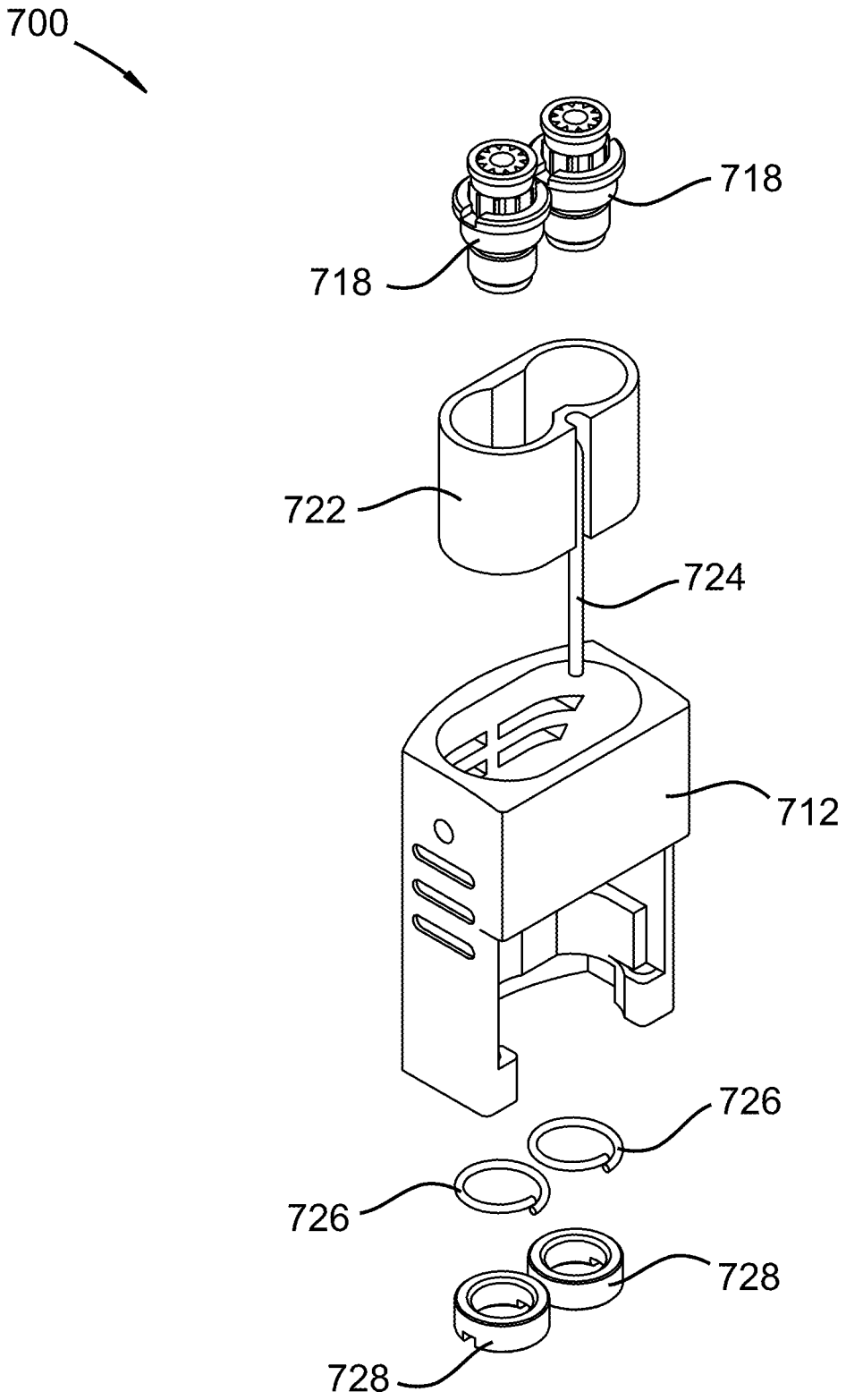
FIG. 7 shows an exploded perspective view of a snap-in burner assembly in accordance with an embodiment of the invention.

FIG. 7 is an exploded perspective view of a burner unit assembly 700 in accordance with an embodiment of the invention. Burner unit assembly 700 includes a snap-in burner unit 712, twin jet nozzles 718, burner heat shield 722, and twin jet retainer 726/728. Burner heat shield includes a high voltage conductor 724 for igniting fuel within snap-in burner unit assembly 700. Snap-in burner unit 700 snaps over one or more gas supply fittings allowing the burner unit to be replaced by a user without any tools.

Figure 8A:
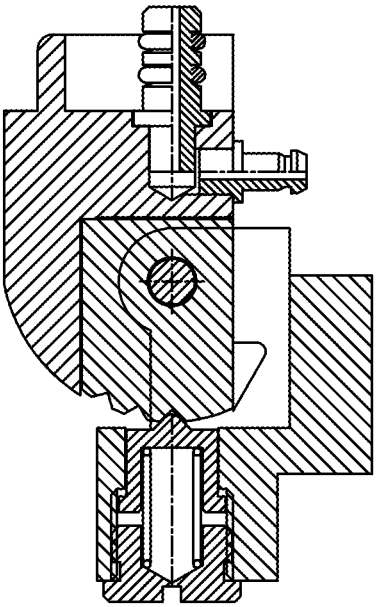
FIGS. 8A, 8B, and 8C show side views of a pocket lighter with a pivoting output port rotated to different angles in accordance with an embodiment of the invention.
Figure 8B:
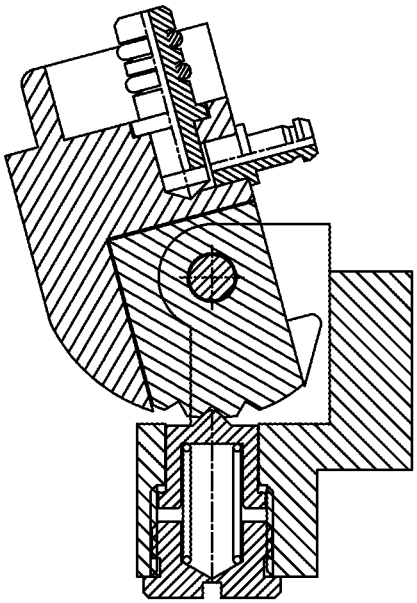
Figure 8C:
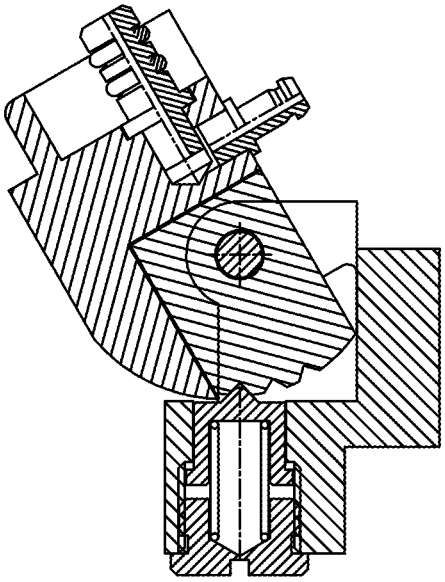

FIGS. 8A, 8B, and 8C show side views of rotations of a pivoting output port in accordance with embodiments of the invention. Each Figure contains a snap-in fitting on the top and a 90-degree angled fitting which connects to a flexible fuel supply hose (612 of FIG. 6). Each pivoting output port includes one or more notches for positionally fixing an angle of rotation of the snap-in burner assembly connected to the snap-in fitting.

Figure 9A:
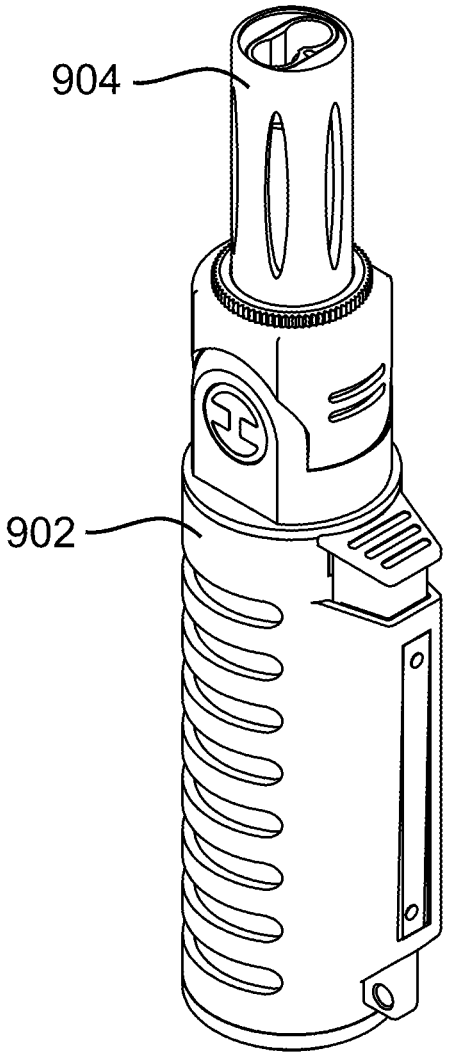
FIGS. 9A and 9B show perspective views of a pocket lighter with a snap-in burner assembly installed and uninstalled in accordance with an embodiment of the invention.

FIG. 9A shows a perspective view of a pocket lighter 902 with an installed snap-in burner unit 904 in accordance with an embodiment of the invention. Burner unit 904 may produce a soft flame, torch flame, twin flame, circular flame, or a combination thereof. Burner unit may be replaced with a desired flame type burner. For example, a user wanting to light a cigar may want a hot twin flame and install a snap-in twin flame burner. In another example, a user may want to light a cigarette and install a snap-in soft flame burner. Snap-in burner unit 904 may be locked into place with a rotational collar or sleeve after snapping in the burner.

Figure 9B:
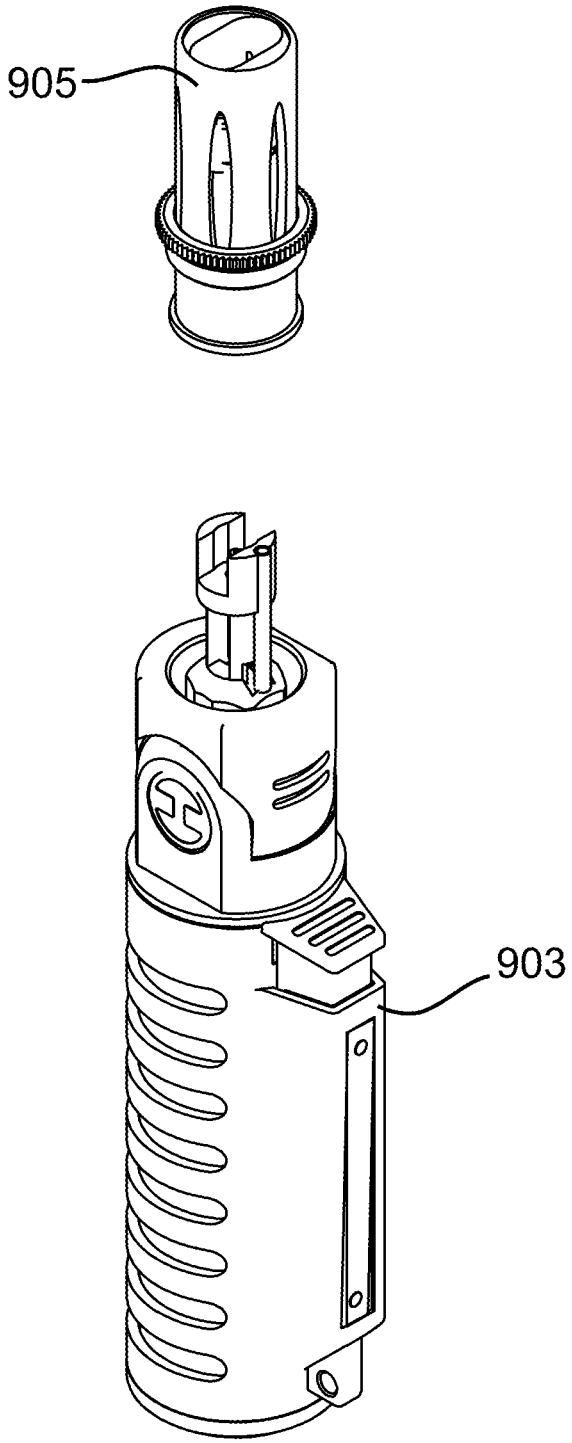
Figure 10:
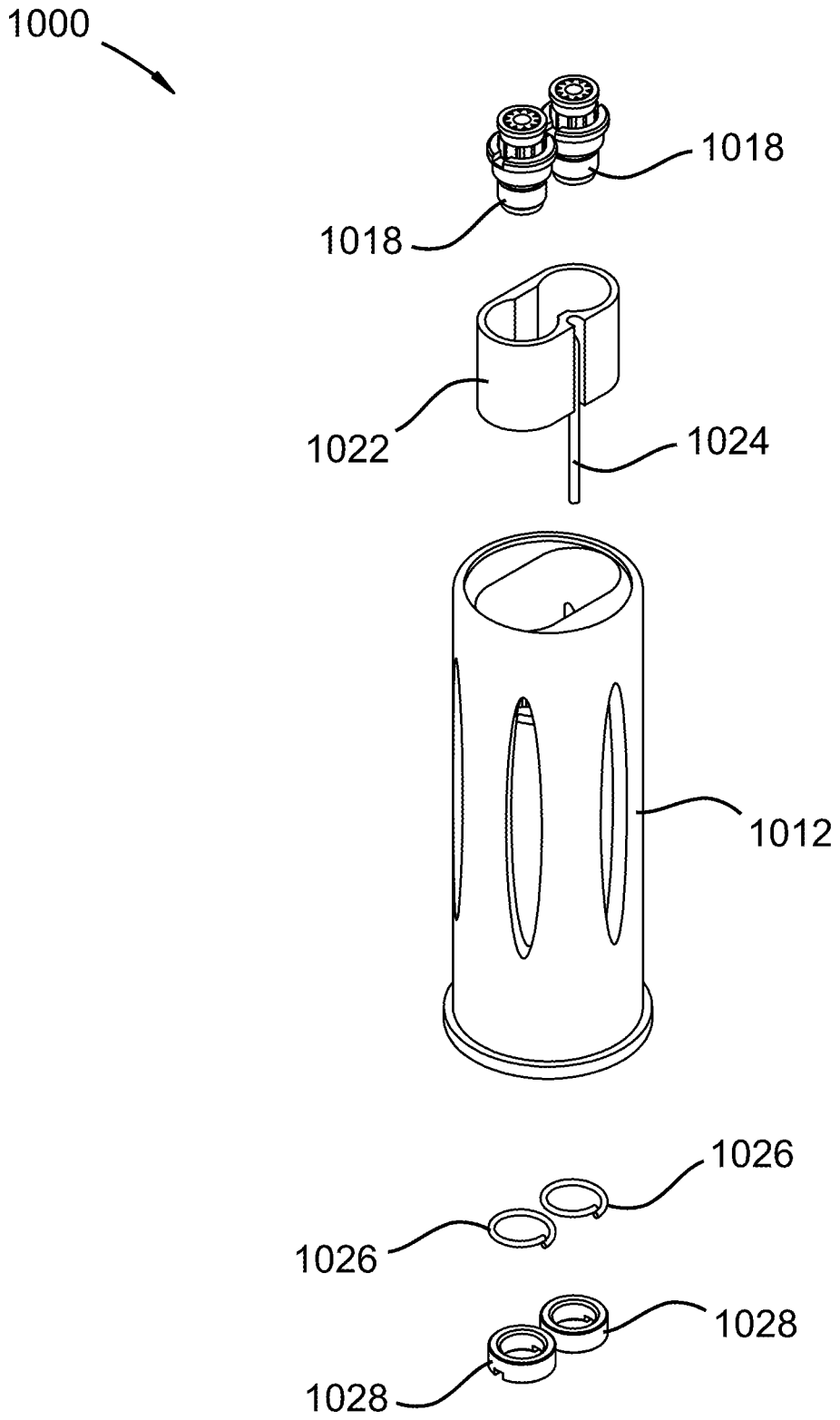
FIG. 10 shows an exploded perspective view of a snap-in burner assembly in accordance with an embodiment of the invention.

FIG. 9B shows a perspective view of a pocket lighter 903 with a removed (snapped out) burner unit 905 in accordance with an embodiment of the invention. Various types of burners and flame configurations may be used with lighters 902/903 and switch as needed for application type and user preference FIG. 10 is an exploded perspective view of a burner unit assembly 1000 in accordance with an embodiment of the invention. Burner unit assembly 1000 includes a snap-in burner unit 1012, twin jet burners 1018, burner heat shield 1022, and twin jet retainer 1026/1028. Burner heat shield includes a high voltage conductor 1024 for igniting fuel within snap-in burner unit assembly 1000. Snap-in burner unit 1000 snaps over one or more gas supply fittings allowing the burner unit to be replaced by a user without any tools.

Figure 11A:
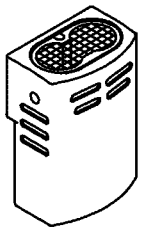
FIGS. 11A-11L depict various snap-in burner assemblies with differing flame types in accordance with an embodiment of the invention.
Figure 11B:
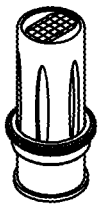
Figure 11C:
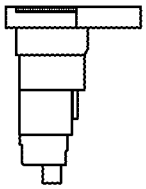
Figure 11D:
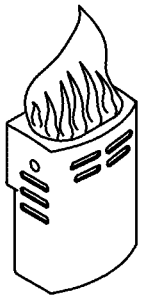
Figure 11E:
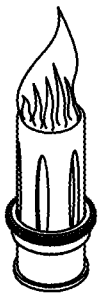
Figure 11F:
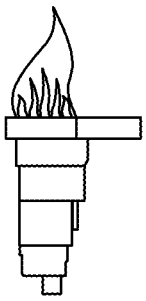
Figure 11G:
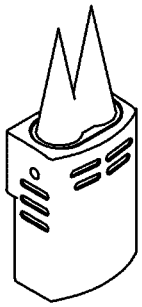
Figure 11H:
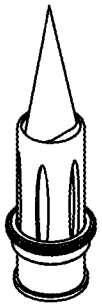
Figure 11I:
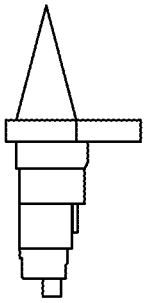
Figure 11J:
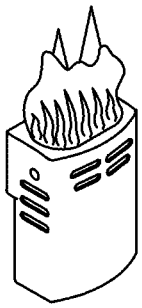
Figure 11K:
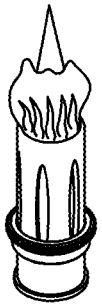
Figure 11L:
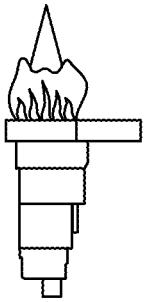

FIGS. 11A-11L depict various snap-in burner assemblies with differing flame types in accordance with an embodiment of the invention. FIGS. 11A-11C are Flameless snap-in burner types. FIGS. 11D-11F are soft flame snap-in burner types. FIGS. 11G-11I are torch flame snap-in burner types. FIGS. 11J-11L are combination flame snap-in burner types.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A pocket lighter comprising:

a snap-in burner assembly unit comprising: a fuel input port, a fuel regulator, a jet nozzle, and a burner cylinder;

a lighter base comprising: a fuel tank, a fuel output port, an ignition source, a fuel lever, and a push button mechanism for actuating the fuel lever and creating a spark;

wherein the fuel input port and the fuel output port mate together forming an airtight seal as the snap-in burner assembly unit is installed within the lighter base;

wherein the lighter base further comprises a piezo-electric spark generator and an insulator;

wherein the snap-in burner assembly unit further comprises a high voltage spark ignitor wire;

and wherein the high voltage spark ignitor wire is electrically connected to the piezo-electric generator when the snap-in burner assembly unit is installed within the lighter base; and wherein the insulator has a tapered opening where a conductive portion of the high voltage spark ignitor wire is received when the snap-in burner assembly unit is installed within the lighter base.

2. The pocket lighter of claim 1, wherein the conductive portion of the high voltage spark ignitor and a high voltage conductor of the piezo-electric spark generator are electrically connected by direct contact, by a defined distance, by a gap, or by a conductive paste when the snap-in burner assembly unit is installed within the lighter base.

3. The pocket lighter of claim 1, wherein the snap-in burner assembly unit produces a soft flame, torch flame, twin flame, circular flame, or a combination thereof.

4. The pocket lighter of claim 3, wherein the snap-in burner assembly unit is a user replaceable accessory of the pocket lighter.

5. The pocket lighter of claim 1, wherein the lighter base further comprises a burner assembly release/lock lever.

6. The pocket lighter of claim 1, wherein the fuel outlet port further comprises one or more O-ring seals.

7. The pocket lighter of claim 5, wherein the release/lock lever is spring loaded.

8. The pocket lighter of claim 7, wherein the release/lock lever is spring loaded in a normally locked position.

9. The pocket lighter of claim 8, wherein the release/lock lever is actuated to release the snap-in burner assembly unit by pushing a pushpin actuator attached to the snap-in burner assembly unit.

10. The pocket lighter of claim 1, wherein the snap-in burner assembly unit is locked in place by rotating a locking nut.

11. The pocket lighter of claim 1, wherein the lighter base output port is a pivoting output port.

12. The pocket lighter of claim 11, wherein the lighter base further comprises a flexible gas tube that connects lighter fuel of the pocket lighter to the pivoting output port.

13. The pocket lighter of claim 12, wherein the snap-in burner assembly unit snaps into the pivoting output port.

14. The pocket lighter of claim 13, wherein the snap-in burner assembly unit is able to rotationally pivot away from the push button mechanism between 0 and 30 degrees.

15. The pocket lighter of claim 14, wherein the pivoting output port comprises one or more notches for positionally fixing an angle of rotation of the snap-in burner assembly unit.

16. The pocket lighter of claim 12, wherein the flexible gas tube connects to a 90-degree fitting of the pivoting output port.

17. The pocket lighter of claim 16, wherein the 90-degree fitting further comprises one or more O-ring seals.

18. The pocket lighter of claim 17, wherein the one or more O-rings seals create an airtight seal with the input port of the snap-in burner assembly unit.

* * * * *